United States Patent [19]

Veillette et al.

[11] 4,363,863

[45] Dec. 14, 1982

[54] LIQUID NEGATIVE DEVELOPER COMPOSITIONS FOR ELECTROSTATIC COPYING CONTAINING POLYMERIC CHARGE CONTROL AGENT

[75] Inventors: Norman T. Veillette, Nashua, N.H.; Charles H. C. Pian, Lexington, Mass.

[73] Assignee: Nashua Corporation, Nashua, N.H.

[21] Appl. No.: 249,159

[22] Filed: Mar. 30, 1981

Related U.S. Application Data

[63] Continuation of Ser. No. 103,544, Dec. 13, 1979, abandoned.

[51] Int. Cl.[3] ..... G03G 9/12

[52] U.S. Cl. ..... 430/115; 430/904; 430/119

[58] Field of Search ..... 430/114, 119, 904

[56] References Cited

U.S. PATENT DOCUMENTS

| | | | |
|---|---|---|---|
| 2,891,911 | 6/1959 | Mayer | 430/115 X |
| 3,079,272 | 2/1963 | Greig | 430/119 |
| 3,244,663 | 3/1965 | Yellin et al. | 430/114 |
| 3,290,251 | 12/1966 | Nelson | 430/114 |
| 3,507,794 | 3/1970 | Fauser et al. | 430/114 |
| 3,523,906 | 8/1970 | Vrancken et al. | 252/316 |
| 3,523,907 | 8/1970 | Vrancken et al. | 252/316 |
| 3,576,744 | 4/1971 | Sharrock et al. | 430/114 |
| 3,668,126 | 6/1972 | Tamai | 430/114 |
| 3,776,849 | 12/1973 | Tellier | 430/114 |
| 3,779,924 | 12/1973 | Chechak | 430/114 |
| 3,856,692 | 12/1974 | Mammino et al. | 430/114 |
| 3,856,745 | 12/1974 | Yamaguchi et al. | 260/42.14 |
| 3,869,397 | 4/1975 | Tellier | 430/114 |
| 3,900,412 | 8/1975 | Kosel | 430/114 |
| 3,969,238 | 7/1976 | Tsuneda | 430/114 |
| 3,977,983 | 8/1976 | Tsuneda | 430/114 |
| 3,998,746 | 12/1976 | Tsuneda | 430/114 |
| 4,040,970 | 8/1977 | Tsuneda | 430/114 |
| 4,104,183 | 8/1978 | Tsubuko et al. | 430/114 |

FOREIGN PATENT DOCUMENTS

| | | |
|---|---|---|
| 1218064 | 1/1971 | United Kingdom . |

*Primary Examiner*—John D. Welsh
*Attorney, Agent, or Firm*—Lahive & Cockfield

[57] ABSTRACT

Disclosed is a developer composition which has improved depletion characteristics. The developer comprises an organic carrier containing latex particles comprising a major amount of a $C_1$–$C_6$ lower alkyl acrylate or methacrylate polymer, a pigment system, a charge control agent consisting of a copolymer of $C_2$–$C_6$ lower alkyl vinyl ether and a vinyl chloride, and an acrylic polymer gel for stabilizing the dispersion. The developer may be used in conventional copying equipment to make greater than about 20,000 copies of acceptable image density.

27 Claims, 2 Drawing Figures

LIQUID NEGATIVE DEVELOPER COMPOSITIONS FOR ELECTROSTATIC COPYING CONTAINING POLYMERIC CHARGE CONTROL AGENT

This is a continuation of application Ser. No. 103,544, filed Dec. 13, 1979.

BACKGROUND OF THE INVENTION

This invention relates to electrostatic developer compositions and to an improved imaging method using the compositions. More particularly, it relates to liquid negative developer compositions of improved stability and an extended service life.

Conventional liquid developers for use in electrostatic copying machines consist of an organic nonpolar liquid carrier having a low dielectric constant and high resistivity containing a toner comprising a solid particulate resinous fixative and a pigment or pigment system. A charge control agent and one or more substances for enhancing the shelf-life of the composition and for maintaining the various solid components as a homogeneously dispersed phase are also included. When a substrate containing a latent electrostatic image is brought into contact with the developer composition, charged components of the developer are attracted preferentially to the oppositely charged latent image and subsequently fixed, typically by the application of heat to evaporate the carrier, to produce a permanent visible image.

In an ideal developing composition, the fixative and pigment should be intimately associated, of uniform small particle size, and should be uniformly charged. This would result in uniform depletion of the toner as images are developed sequentially and in uniform density of the successively produced copies. In practice, this ideal property of developing compositions has been difficult to achieve. The static charge imparted to the solid particles in such a composition by the charge control agent is typically a function of the chemical properties of the agent and the toner particles and of the surface area of the particles. Thus, relatively small differences in particle size result in particles of varying charge, and in use, the larger particles in the composition are preferentially depleted. As a result, the image density of successively produced copies decreases since a given charged area of the latent image on the substrate attract a substantially constant charge, but that quantity of charge is associated with a smaller mass of toner. Also, since the majority of liquid developing compositions contain vehicle-soluble charge control agents, and since the charge control agent is depleted to a lesser extent than the fixative and pigment, as successive copies are produced the net charge on particles remaining in the developer varies in a complicated way resulting in variations in the image density of the copies.

The prior art teaches various approaches to solving this problem, but none have been wholly successful. Currently available copying machines are equipped with means for monitoring the particle density of liquid developers. When the particle density falls below a selected level, developer concentrate and/or vehicle is added to the working developer suspension to adjust the particle density to more optimal levels. However, the image density of successively developed copies nevertheless decreases since the proportion of optimally charged larger sized particles in the working developer becomes smaller. At a point when the image density of the copies falls below an acceptable level, additional relatively large quantities of vehicle are added to the working developer mix, typically by a key operator or a service representative. The result is a marked decrease in the particle density as read by the detector. This low particle density reading triggers the introduction of a relatively large quantity of toner concentrate. Thus, the proportion of ideally charged particles in the developer composition and the image density of subsequently produced copies are sharply increased, but still does not attain the level achieved by fresh developer. As additional copies are made, the developer again becomes gradually depleted, and the cycle of piecemeal replenishment followed by a sharp increase on addition of more vehicle is repeated. After several such cycles, and typically in the 10,000+ copy range, the developer no longer produces copies of acceptable image density and can no longer be upgraded sufficiently. This necessitates removal of the depleted developer and replacement with a completely fresh batch.

To graphically illustrate this phenomenon, image density may be plotted as a function of the number of copies produced. Such a plot, as depicted in the drawing, shows a gradual decrease in image density as the developer becomes preferentially depleted, despite the piecemeal replenishment of toner, followed by a sharp increase in image density following the addition of a large quantity of developer, and plural repetitions of the cycle at lower image densities until the image density is unacceptable.

SUMMARY OF THE INVENTION

The instant invention provides a developer composition which has improved depletion characteristics. Use of the developer in conventional electrostatic copying machines employing liquid negative developer allows upwards of 20,000 copies to be made before the developer must be replaced. This property of the developer of the invention may be traced to the inclusion in the composition of a novel charge control agent in combination with a particular class of resinous latexes which results in a composition comprising particles having a more uniform charge to mass distribution. The charge control agent is substantially insoluble in the vehicle and intimately associated by second order forces with the resinous latexes and the pigment. Preferably, the nonaqueous suspension is maintained in a homogeneous state with the aid of a resinous gel engineered to have solubility properties which render it on the borderline of solubility-insolubility in the vehicle at the temperature of use. The gel, like the charge control agent, is engineered to be compatible and to be intimately associated with the latex. In one aspect, the invention provides a novel electrostatic developing composition having improved depletion characteristics. In another aspect, the invention provides an improved method of imaging using the developing composition.

In its broadest aspect, the developer composition of the invention comprises an organic liquid carrier having a resistivity greater than $10^9$ ohm-cm and a dielectric constant less than 3. Toner particles are dispersed within the carrier. The particles comprise an admixture of a pigment, a charge control agent, and a resinous latex, all intimately associated by ball milling. The latex comprises, as an essential ingredient, a vinyl polymer or copolymer, insoluble in the vehicle, which includes a major amount of monomer units selected from the group consisting of:

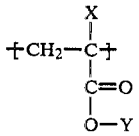

where X is H or $CH_3$ and Y is $C_nH_{2n+1}$, where $1 \leqq n \leqq 6$.

The charge control agent comprises a copolymer of 10 to 50 parts of a lower alkyl ($C_2$–$C_6$) vinyl ether and 50 to 90 parts of a vinyl chloride. The vinyl chloride component of the charge control agent is primarily responsible for imparting the negative static charge to the copolymer. The lower alkyl group attached to the copolymer through the ether linkage is chiefly responsible for imparting to the charge control agent its ability to remain intimately associated with the resinous, vehicle-insoluble vinyl polymer fixative.

In preferred embodiments, the developer includes a gel for stabilizing the dispersion comprising a vinyl polymer which is on the borderline of solubility in the vehicle. It includes a major amount of monomer units selected from the group consisting of:

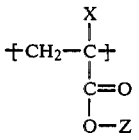

where x is H or $CH_3$ and Z is $C_nH_{2n+1}$, where $8 \leqq n \leqq 20$. The preferred latex and gel pair both consist essentially of an intimate admixture of a first vinyl polymer containing $C_1$–$C_6$ acrylate or methacrylate and a second vinyl polymer containing $C_8$–$C_{20}$ acrylate or methacrylate. The latex contains a major amount of the first polymer and a minor amount of the second so that it remains insoluble in the carrier. For example, the weight ratio between the first and second polymers making up the latex may be on the order of 3 to 1. The gel contains a major amount of the second polymer and a minor amount of the first so that it remains on the borderline of solubility in the carrier and is swelled when placed in contact with the carrier. For example, the gel can comprise about 85 parts by weight of the second polymer and 15 parts by weight of the first polymer.

The latex may comprise a homopolymer of $C_1$–$C_6$ acrylic or methacrylic acid or a copolymer or terpolymer comprising one or more of the lower alkyl acrylates or methacrylates with each other or with a wide variety of other vinyl monomers. Similarly, the gel can comprise a homopolymer of $C_8$–$C_{20}$ acrylate or methacrylate or a copolymer of these monomer units with each other or with various other vinyl monomers having substituents which can tailor the solubility properties of the polymer to the desired range.

The preferred charge control agent is a copolymer of butyl vinyl ether and vinyl chloride, and the preferred ratio of comonomers is about 25 parts by weight vinyl ether to about 75 parts by weight vinyl chloride. The molecular weight of the polymer is not critical; the advantages of the composition can be achieved using copolymers in the molecular weight range of 10,000 to 150,000. Excellent results have been achieved with a copolymer having a median molecular weight in the 70,000 range. The chemical nature of the charge control agent is believed to be a critical aspect of the invention. For example, copolymers of butyl vinyl ether and methyl methacrylate as well as copolymers of vinyl chloride and vinyl acetate failed to impart to otherwise identical developers the desired depletion properties that are achieved with the charge control agent of the invention.

The preferred charge control agent is commercially available from BASF Wyandotte Corporation under the trademark LAROFLEX-MP 35.This copolymer is synthesized as a latex and subsequently spray dried. During synthesis, anionic surfactants are used as dispersion stabilizers. These inevitably become associated with the copolymer, both in physical mixture and covalently bonded thereto. The presence of these surfactants is not detrimental to the utility of the copolymer as a charge control agent, but rather is believed to contribute to the ability of the material to impart a negative charge to the developers.

Accordingly, objects of the invention include the provision of a liquid negative developer composition for use in electrostatic copying chracterized by improved depletion properties, that is, a smaller decrease in image density with successive copies as compared with prior art developers. Another object of the invention is to provide a developing composition which is relatively simple to manufacture and stable both in use and during storage. Another object of the invention is to provide a vehicle-insoluble charge control agent for liquid negative developing compositions which results in a developer having a high ratio of optimally charged particles and thus a slower rate of image density degradation as plural copies are made using the developer.

These and other objects and features of the invention will be apparent from the following description of some preferred embodiments and from the drawing wherein:

FIG. 1 is a plot of image density in arbitrary units versus number of copies illustrating the phenomenon of progressive decrease in image density with increases in the total number of copies made with a given developer batch; and FIG. 2 is a plot of image density in arbitrary units versus number of copies comparing the depletion properties of the developers of the invention to the depletion properties of commercially available developers.

DESCRIPTION OF THE PREFERRED EMBODIMENT

Figure 1:
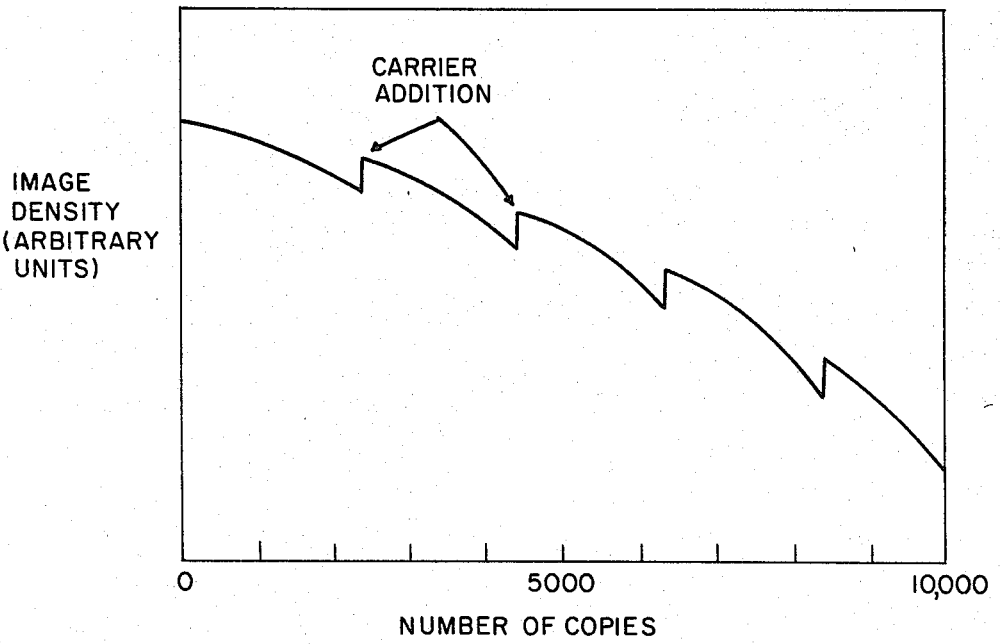

Broadly, the several objects of the instant invention are accomplished by providing a liquid negative developer which essentially consists of a carrier or vehicle, a pigment or pigment system, and a resinous latex and charge control agent which are engineered to be insoluble in the vehicle and to have a significant affinity for each other. Optionally, in place of conventional dispersion stabilizers normally employed in such developing compositions, the developer may also include a gel which comprises a resinous material on the borderline of solubility in the vehicle at the temperature of use and also has an affinity for the latex.

The carriers useful in the composition of the invention are nonpolar solvents or solvent systems of the type conventionally used in prior art liquid developers. The carrier will have a resistivity greater than about $10^9$ ohm-cm and a dielectric constant less than about 3. As known to those skilled in the art, it will be characterized by an evaporation rate suitable for rapid, e.g., two second, evaporations from the substrate to be developed when exposed to temperatures below which paper is charred. It will preferably be free of aromatic liquids and other excessively toxic or corrosive components. Also, as is known, it should have a viscosity low enough to permit rapid migration of particles which are attracted to the electrostaticly charged image to be developed. Typically, the viscosity of the vehicle will range between about 0.5 to 2.5 centipoise at room temperature.

Nonlimiting examples of suitable vehicles include petroleum fractions which are substantially odorless, relatively inexpensive, and commercially available such as those sold by Humble Oil and Refining Company under the trademarks ISOPAR G, ISOPAR H, ISOPAR K, and ISOPAR L. These materials comprise various mixtures of about $C_8$–$C_{16}$ hydrocarbons.

The pigment or pigment system employed in the composition of the invention is also conventional. The preferred method of imparting color to the toner particles is to use a fine solid particulate pigment in combination with one or more dyes which associate with the particles' resinous components. Carbon black particles in the submicron range are preferred, but powdered metals and metal oxides may also be used. Various dyes of recognized utility in imparting color to vinyl acrylic resins may be used in combination with the particulate pigment. The presently preferred pigment system for use in the composition of the invention comprises Printex 1404, a carbon black sold by Degussa Inc. having a mean particle size of 0.029 microns, plus alkali blue (BASF Wyandotte) and phthalo green (Herculese Inc.)

The latex component of the developing composition comprises a vehicle insoluble vinyl polymer or copolymer preferably mixed with other vehicle insoluble materials such as wood rosins and wax, and preferably blended with smaller quantities of vehicle soluble resins. A critical component of the latex is a polymer containing $C_1$–$C_6$ alkyl esters of acrylic or methacrylic acid. As the length of the ester linked side chain increases, in general, the solubility of the polymer in the carrier increases. Accordingly, methyl acrylate and methyl methacrylate units are preferred. However, as long as the polymer contains a major amount of these acrylic or methacrylic units, other vinyl units in addition to those specified above may be incorporated in the polymer without seriously adversely affecting the properties of the developer. Nonlimiting examples of monomers which can be copolymerized or terpolymerized with these esters include vinyl acetate, hydroxy ethyl acrylate and methacrylate, hydroxy propyl acrylate and methacrylate, glycidyl acrylate and methacrylate, acrylonitrile, methacrylonitrile, acrylamide, methacrylamide, acrylic and methacrylic anhydride, monomethyl maleate, monomethyl fumarate, monoethyl maleate, monoethyl fumarate, styrene, vinyl toluene, maleic acid and anhydride, and crotonic acid and anhydride. Small amounts of $C_7$–$C_{20}$ alkyl acrylates or methacrylates may also be used. A preferred latex component comprises a copolymer of methacrylic acid and methyl methacrylate. The molecular weight of the polymer is not critical and may be varied between about 50,000 and 100,000.

The currently preferred latex consists of an intimate blend, held together by second order forces, of 3 parts vehicle insoluble copolymer and 1 part vehicle soluble copolymer. The vehicle insoluble component comprises 130 parts methyl methacrylate copolymerized with one part methacrylic acid. The vehicle soluble component comprises 20 parts lauryl methacrylate copolymerized with 5 parts glycidyl methacrylate. Materials of this type are available commercially and may be synthesized by conventional techniques using free radical initiator type catalysts such as benzoyl peroxide or azobis isobutyro nitrile.

The charge control agent of the composition comprises a copolymer of 10 to 50 parts of a lower alkyl ($C_2$–$C_6$) vinyl ether and 50 to 90 parts vinyl chloride. It is believed that the chlorinated component of the copolymer is responsible for its ability to impart negative charge to the toner; the lower alkyl group attached to the polymer chain via an ether linkage is believed to be responsible for imparting to the polymer its ability to remain in intimate association with the latex. Generally, as the molecular weight of the alkoxy side chain in the copolymer increases, the copolymer's affinity for the carrier increases and its affinity for the latex correspondingly decreases. The charge control agent is preferably included in the composition such that it constitutes between about 5% and 10% of the total weight of the composition, excluding the carrier. It is an important feature of the invention tht the charge control agent be substantially insoluble in the carrier and remain in intimate association with the latex. This property, in combination with its outstanding ability to impart a negative charge to the resinous components of the developer composition, is believed to be responsible for the improved depletion properties and the lower rate of image density decrease characteristic of compositions of the invention. In general, the greater the length of the alkoxy side chain within the range specified, the smaller is the fraction of vinyl ether that must be included in the copolymer to achieve the advantages of the invention. Thus, it can be appreciated that the solid latex and charge control agent cooperate to impart new and useful properties to developing compositions embodying the invention.

The currently preferred charge control agent comprises a copolymer of 25 parts isobutyl vinyl ether and 75 parts vinyl chloride. This copolymer is available commercially from BASF Wyandotte Corporation under the trademark LAROFLEX-MP 35. LAROFLEX-MP 35 is synthesized from isobutyl vinyl ether and monochloroethane employing an interfacial polymerization which results in the formation of a latex which is sprayed dried. The copolymerization is conducted in the presence of anionic surfactants which become mixed with the resin. Attempts to remove the surfactants have led to the conclusion that at least a fraction of the surfactant content is covalently bonded to the copolymer. Typically, the surfactant used is a mixture of saturated and unsaturated aliphatic hydrocarbon chains containing 10–30 carbon atoms multiply substituted with sulfonate groups. These alkali metal petroleum sulfonates are present only in trace quantities and do not adversely affect the properties of the charge control agent. In fact, it is believed that the presence of the anionic surfactants mixed with or covalently bonded to the polymer may enhance its ability to impart a negative charge.

A highly preferred but optional component of the developer composition is a polymeric gel which stabilizes the dispersion of solid particles. The gel is designed to be both compatible with the vinyl component of the latex and to be on the borderline of solubility-insolubility in the organic non-polar carrier. It comprises, as an essential component, a polymer or a copolymer containing a major amount of monomer units selected from the group consisting of $C_8$–$C_{20}$ esters of acrylic or methacrylic acid. This developer component has a molecular weight in the range of $10^3$ to about $10^6$ and swells when mixed with non-polar organic carriers or the type described above. Such $C_8$–$C_{20}$ alkyl esters may be homopolymerized or copolymerized with each other or various other vinyl type monomers. Nonlimiting examples of suitable comonomers include vehicle insoluble monomers such as lower alkyl esters of acrylic and methacrylic acids, provided that the ratio of the monomers is low enough such that solvation of the resulting copolymer in the vehicle is assured. Other useful compounds include glycidyl methacrylate or acrylate, crotonic, maleic, atropic, fumaric, itaconic, and citraconic acids, acrylic, methacrylic, and maleic, anhydrides, acrylonitrile, methacrylonitrile, acrylamide, hydroxy ethyl methacrylate and acrylate, hydroxy propyl methacrylate and acrylate, dimethyl amino methyl methacrylate and acrylate, allyl alcohol, cinnamic acid, methallyl alcohol, propargyl alcohol, and mono and dimethyl maleate and fumarate.

A preferred approach to producing a stable nonaqueous dispersion is to employ a mixture of two identical copolymers in different proportions to produce both the gel and the vinyl component of the latex. Thus, for example, a copolymer of lauryl methacrylate and glycidyl methacrylate can be blended and ball milled with a copolymer of methacrylic acid and methyl methacrylate, in a ratio of 1 to 3, to produce a vehicle insoluble latex blend held together by second order forces. This latex is added to the developer together with a gel comprising, e.g., 85 parts of lauryl methacrylate-glycidyl methacrylate copolymer and 15 parts of a methyl methacrylate-methacrylic acid copolymer which is on the borderline of solubility in the vehicle.

The developer compositions are manufactured by separately synthesizing the gel and the latex, and then ball milling these components together with the other components of the developer to form an intimate blend having a mean particle size in the 0.2–0.3 micron range. Thus, to make the resinous components, one produces a multipolymer from, for example, lauryl methacrylate and glycidyl methacrylate, in an Isopar solvent with the aid of a suitable catalyst, and then forms a second polymer, for example, from methacrylic acid and methyl methacrylate, either in the same reaction medium in which the first polymer was synthesized or a separate reaction medium. Both the gel and the latex can be produced in this manner since, by controlling the relative amounts of the lauryl methacrylate copolymer and the methyl methacrylate copolymer, the resulting intimate admixture of copolymers can be made insoluble in the Isopar carrier or on the borderline of solubility. Thus, one part of the lauryl methacrylate copolymer may be blended with three parts of the methyl methacrylate copolymer to form a particulate Isopar-insoluble latex; one part methyl methacrylate copolymer may be blended with about six parts of the lauryl methacrylate copolymer to form a polymeric gel on the borderline of solubility in the Isopar carrier. The relative amounts of the polymer species constituting the blend may vary widely provided that the $C_1$–$C_6$ acrylate or methacrylate content of the latex is set such that the resulting polymer, or the blend (if used), is insoluble in the carrier, and the $C_8$–$C_{12}$ acrylate or methacrylate content of the gel is set such that the resulting polymer, or the blend (if used) is on the borderline of solubility in the carrier.

These components are then ball milled in the carrier together with the lower alkyl vinyl ether-vinyl chloride charge control agent, the pigment system, and preferably rosin and wax, for a sufficient amount of time, typically 20–40 hours, to produce a homogeneous blend of all components having a particle size of around 0.2–0.3 microns with particle distribution around 0.1–1.5 microns. The currently preferred ratios of ingredients are given in the examples which follow.

The invention will be further understood from the following nonlimiting examples.

EXAMPLES

Soluble Multipolymer Precursors

A. 800 g of lauryl methacrylate and 3.54 g of benzoyl peroxide are added to 1.3 liters of Isopar G in a 5 liter flask below a temperature of 80° C. and allowed to react for 6 hours under a nitrogen atmosphere to form a lauryl methacrylate homopolymer. The overall reaction concentration is about 40%, and about a 95% conversion to the polymer is achieved.

B. The procedure of A is repeated except that 40 g of glycydyl methacrylate is included in the reaction flask and a 20:1 poly (lauryl-glycidyl) methacrylate copolymer is produced. Less than about 10% of the originally added monomers remain unreacted.

C. The procedure of B is repeated, and after the six hour reaction time, the reaction medium is allowed to reach the benzoyl peroxide decomposition temperature of 80° C. Next, 40 g of methacrylic acid and 0.54 g hydroquinone are added to the polymer solution and the solution is maintained at about 93° C. for 12–15 hours to form a small amount of hydroquinone-methacrylic acid complex.

D. The procedure of C is repeated except that 20 g of acrylic acid are substituted for the 40 grams of methacrylic acid. A 20:1 poly (lauryl-glycidyl) methacrylate copolymer and a complex of hydroquinone and acrylic acid are produced. Polymer yield is on the order of 90+%.

E. The procedure of C is repeated except that 10 g of crotonic acid are substituted for the 40 grams of methacrylic acid. A 20:1 poly (lauryl-glycidyl) methacrylate copolymer and a complex of hydroquinone and crotonic acid are produced. Polymer yield is on the order of 90+%.

F. The procedure of C is repeated except that 20 g of methacrylic acid is substituted for the 40 grams of methacrylic acid. A 20:1 poly (lauryl-glycidyl) methacrylate copolymer and a complex of hydroquinone and methacrylic acid are produced.

Gel Preparation

G. 40 g of methacrylic acid and 0.5 g of hydroquinone are added to 1 liter of Isopar G and maintained at about 90° C. for about 10 hours. Next, 40 grams of lauryl methacrylate, 18 g methyl methacrylate, and 0.5 g benzoyl peroxide are added to the reaction flask to initiate polymerization. Polymerization is continued for five hours to produce a methacrylic acid-lauryl methacrylate-methyl methacrylate terpolymer. The terpolymer solution/dispersion is added to about 100 grams of soluble precursor A and ball milled to produce a substantially homogeneous gel on the borderline of solubility in Isopar G.

H. The procedure of G is repeated except that 100 g of soluble precursor B is substituted for precursor A. After ball milling for 10 hours, a substantially homogeneous gel on the borderline of solubility in Isopar G is produced.

I. 102 g (dry weight) of soluble precursor C is mixed with 18 g methyl methacrylate, 0.3 g benzoyl peroxide, and 900 ml of Isopar G and reacted in a 2 liter flask under a nitrogen atmosphere for 5 hours. A gel is formed which is on the borderline of solubility in Isopar G at room temperature. Substantially no free monomer can be detected in the reaction flask.

J. The procedure of I is repeated except that 100 g of precursor D is substituted for precursor C. A gel similar in properties to that described in section I is produced.

K. The procedure of I is repeated except that 100 g of precursor E is substituted for precursor C. A gel similar in properties to that described in section I is produced.

L. 84 g (dry weight) of a precursor similar to precursor C, except that only 10 grams of methacrylic acid are added after polymerization of the lauryl-glycidyl copolymer, are added to 36 grams methyl methacrylate and 0.3 g benzoyl peroxide in 900 ml Isopar G. The mix is maintained under a nitrogen atmosphere for 5 hours at a temperature of less than 80°C. A viscous gel is produced, and less than about 4% unreacted polymer can be found in the reaction flask.

M. 90 g (dry weight) of precursor F are added to 30 g methyl methacrylate and 0.3 g benzoyl peroxide in 900 ml Isopar G. The mix is maintained under a nitrogen atmosphere for 5 hours at a temperature of less than about 80° C. A viscous, but less gelled polymer is produced with about 93% conversion.

Latex Preparation

N. 50 g (dry weight) of precursor F, 150 g of methyl methacrylate, and 0.75 g benzoyl peroxide are reacted in sufficient Isopar G to produce a 20% reaction concentration for four hours. A latex is formed which is insoluble in the Isopar. Less than about 5% unreacted monomer can be found in the reaction solution.

O. The procedure of N is repeated, except that 40 g (dry weight) precursor F is used instead of the 50 grams of procedure N, 160 g methyl methacrylate is used instead of 150 g, and 0.8 g benzoyl peroxide is used instead of 0.75 g. As a result of the reaction, a latex is formed with 90% conversion.

P. The procedure of N is repeated, except that 25 mg (dry weight) precursor F is used instead of the 50 grams, 170 g methyl methacrylate is used instead of 150 g, and 0.9 g benzoyl peroxide is used instead of 0.75 g. As a result of the reaction, a fine latex is formed with 94.5% conversion.

Developer Preparation

The developer is prepared by adding to Isopar G the following ingredients so that a dispersion containing 20–25% solids is produced.

| Ingredient | Percentage by Weight |
|---|---|
| latex N, O, or P | 20–30% |
| charge control agent | 5–10% |
| wax | 5–15% |
| wood rosin | 5–15% |
| pigment | 20–30% |
| gel G, H, I, J, K, L or M | 10–25% |

A preferred composition consists of, as weight percent solids:

| Ingredient | Weight Percent |
|---|---|
| latex | 20–30% |
| gel | 15–25% |
| Laroflex MP-35[1] | 10% |
| wax[2] | 10% |
| wood rosin[3] | 10% |
| pigment[4] | 25% |

[1]a copolymer of 25% isobutyl vinyl ether and 75% vinyl chloride, median MW 70,000–80,000, distribution between 300,000 and 10,000.
[2]parrafin wax
[3]Hercules Chemical Co.
[4]19 parts carbon black, 2 parts alkali blue, 4 parts phtholo green.

The dispersion is then placed in a 1.6 gallon ball mill supplied with steel balls and milled for 20–40 hours. It is then diluted with Isopar G to appropriate developer concentration and milling is continued for another hour. The mean particle size of the compositions around 0.2–0.3 microns.

Figure 2:
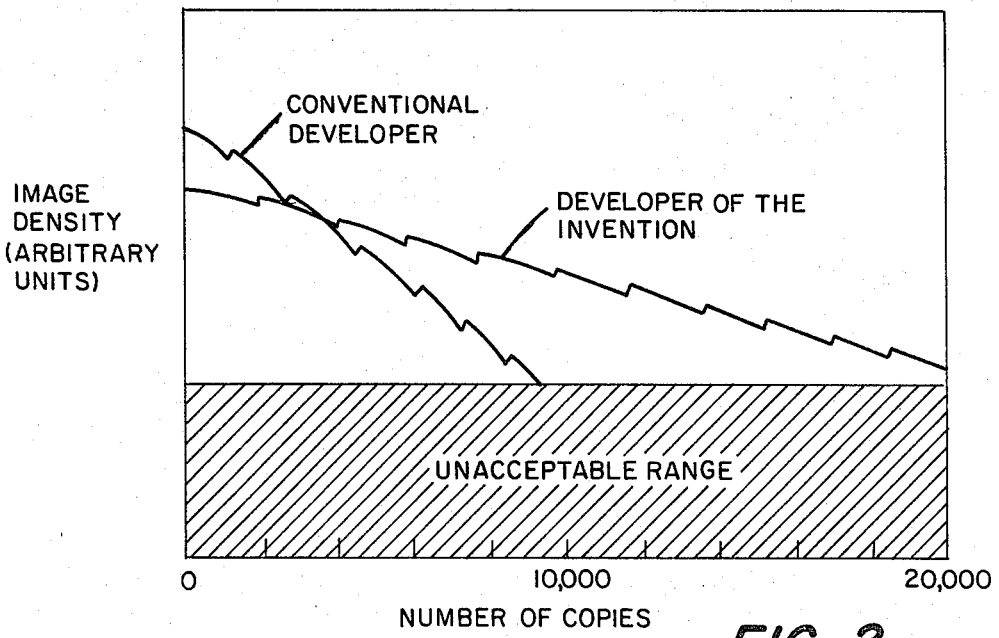

Developer compositions prepared in accordance with the foregoing exemplary procedures have been extensively tested in commercially available copying equipment which utilize negative liquid developer. Developers produced in accordance with the invention have been found to be capable of continuous operation without replacement in the twenty thousand plus copy range. In contrast, currently marketed negative liquid developers must be replaced in the 10,000–15,000 copy range in order to achieve acceptable image density. Typical plots of the image density of copies produced versus the number of copies for currently available liquid negative developers and the developers of this invention are shown in FIG. 2.

Comparative Example

Toner formulations substantially identical to those set forth above have been prepared, except that the lower alkyl vinyl ether-vinyl chloride charge control agent was replaced with a different polymer.

A multipolymer of lauryl methacrylate, 2 ethyl hexylacrylate, methyl methacrylate, and isobutyl vinyl ether, when used in place of the charge control agent of the invention, produces a developer which is of amphoteric character with 60% negative voltage and 40% positive. A multipolymer of vinyl chloride, vinyl alcohol, and vinyl acetate, when used in place of the charge control agent of the invention, produces an amphoteric developer with 75% negative voltage and 25% positive. Similarly, if the charge control agent of the invention is replaced with a copolymer of vinyl chloride-vinyl acetate, a developer having amophoteric properties is produced.

In view of the foregoing teaching it will be appreciated that various compositions in addition to those specifically disclosed herein can be formulated without departing from the spirit and scope of the invention. Accordingly, other embodiments are within the following claims:

What is claimed is:

1. A non-amphoteric liquid negative developer composition of improved depletion properties for developing an electrostatic latent image on the surface of an image bearing member, said composition comprising:

a organic liquid carrier having a resistivity greater then $10^9$ ohm-cm and a dielectric constant less than 3;

thermoplastic resin particles dispersed within said carrier, said particles comprising an intimate mixture of:

a vinyl polymeric latex, insoluble in said carrier, and including a major amount of monomer units selected from the group consisting of:

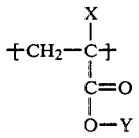

where X is H or $CH_3$ and Y is $C_nH_{2n+1}$, where $1 \leqq n \leqq 6$;

a pigment; and a charge control agent, substantially insoluble in the carrier, which imparts a negative charge to the composition and is present in association with the vinyl polymeric latex, said charge control agent consisting essentially of a copolymer of 10–50 parts of a lower alkyl ($C_2$–$C_6$) vinyl ether and 50–90 parts of a vinyl chloride, the amount of said copolymer included in said composition being substantially less than the amount of said latex.

2. The developer of claim 1 further comprising a gel for stabilizing said dispersion comprising a vinyl polymer which swells in the presence of said carrier and includes a major amount of monomer units selected from the group consisting of:

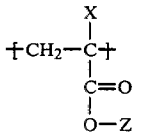

where X is H or $CH_3$ and Z is $C_nH_{2n+1}$, where $8 \leqq n \leqq 20$.

3. The developer of claim 2 wherein said latex and said gel both consist essentially of an intimate admixture of a first vinyl polymer containing monomer units selected from the group consisting of:

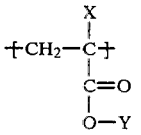

where X is H or $CH_3$ and Y is $C_nH_{2n+1}$, where $1 \leqq n \leqq 6$, and a second vinyl polymer containing monomer units selected from the group consisting of:

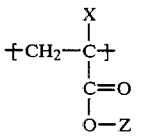

where X is H or $CH_3$ and Z is $C_nH_{2n+1}$, where $8 \leqq n \leqq 20$, said latex containing a major amount of said first polymer so that it remains insoluble in said carrier, said gel containing a major amount of said second polymer so that it swells in the presence of said carrier.

4. The developer of claim 3 wherein said latex comprises about 3 parts by weight of said first polymer and about 1 part by weight of said second polymer.

5. The developer of claim 3 wherein said gel comprises about 85 parts by weight of said second polymer and about 15 parts by weight of said first polymer.

6. The developer of claim 3 wherein said first polymer in a copolymer of methacrylic acid and methyl methacrylate and said second polymer is a copolymer of lauryl methacrylate and glycidyl methacrylate.

7. The developer of claim 1 wherein said charge control agent comprises a copolymer of butyl vinyl ether and vinyl chloride comprising between about 5%–10% of the total weight of said composition, excluding the carrier.

8. The developer of claim 1 wherein said charge control agent comprises a copolymer of about 25 parts by weight lower alkyl vinyl ether and about 75 parts by weight vinyl chloride.

9. The developer of claim 1 wherein said charge control agent comprises a copolymer of lower alkyl vinyl ether and vinyl chloride containing covalently bonded anionic surfactant.

10. The developer of claim 9 wherein said anionic surfactant comprises an alkali metal sulfonate substituted aliphatic surfactant containing between 10 and 40 carbon atoms.

11. The developer of claim 1 further comprising wax and a wood rosin.

12. A non-amphoteric liquid negative developer composition of improved depletion properties for developing an electrostatic latent image on the surface of an image bearing member, said composition comprising:

an organic liquid carrier having a resistivity greater than $10^9$ ohm-cm and a dielectric constant less than 3;

thermoplastic resin particles dispersed with said carrier, said particles comprising an intimate admixture of:

a vinyl polymeric latex, insoluble in said carrier, and including a major amount of monomer units selected from the group consisting of:

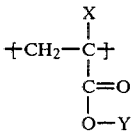

where X is H or $CH_3$ and Y is $C_nH_{2n+1}$, where $1 \leqq n \leqq 6$;

a pigment;

a charge control agent, substantially insoluble in the carrier, which imparts a negative charge to the composition and is present in association with the vinyl polymeric latex, said charge control agent consisting essentially of a copolymer of 10–50 parts of butyl vinyl ether and 50–90 parts of a vinyl chloride, the amount of said copolymer included in said composition being substantially less than the amount of said latex; and a gel for stabilizing said dispersion comprising a vinyl polymer which swells in the presence of said carrier and includes a major amount of monomer units selected from the group consisting of:

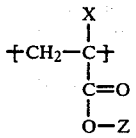

where X is H or $CH_3$ and Z is $C_nH_{2n+1}$, where $8 \leqq n \leqq 20$.

13. The developer of claim 12 wherein said charge control agent comprises a copolymer of about 25 parts butyl vinyl ether and about 75 parts vinyl chloride.

14. The developer of claim 13 wherein said charge control agent includes a minor amount of an alkali metal sulfonate substituted aliphatic surfactant containing between 10 and 40 carbon atoms.

15. The developer of claim 12 comprising the following ingredients in the following parts by weight, dispersed in said carrier:

| Ingredient | Parts by Weight |
|---|---|
| latex | 20–30 |
| pigment | 20–30 |
| charge control agent | 5–10 |
| wax | 5–15 |
| wood rosin | 5–15 |
| gel | 10–25 |

16. The developer of claim 12 comprising the following ingredients in the following parts by weight, dispersed in said carrier:

| Ingredient | Parts by Weight |
|---|---|
| latex | 20–30 |
| pigment | 25 |
| isobutyl vinyl ether-vinyl chloride polymer | 10 |
| parrafin wax | 10 |
| wood rosin | 10 |
| gel | 15–25 |

17. In a method of creating an image, the improvement comprising applying under electrostatic control to an electrostatic image bearing member so as to selectively deposit a coating thereon, a non-amphoteric liquid negative electrostatic developer comprising:

an organic liquid carrier having a resistivity greater than $10^9$ ohm-cm and a dielectric constant less than 3;

thermoplastic resin particles dispersed within said carrier, said particles comprising an intimate admixture of:

a vinyl polymeric latex, insoluble in said carrier, and including a major amount of monomer units selected from the group consisting of:

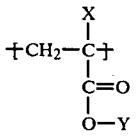

where X is H or $CH_3$ and Y is $C_nH_{2n+1}$, where $1 \leqq n \leqq 6$;

a pigment; and a charge control agent, substantially insoluble in the carrier, which imparts a negative charge to the composition and is present in association with the vinyl polymeric latex, said charge control agent consisting essentially of a copolymer of 10–50 parts of a lower alkyl ($C_2$–$C_6$) vinyl ether and 50–90 parts of a vinyl chloride, the amount of said copolymer included in said composition being substantially less than the amount of said latex.

18. The method of claim 17 wherein said developer further comprising a gel for stabilizing said dispersion comprising a vinyl polymer which swells in the presence of said carrier and includes a major amount of monomer units selected from the group consisting of:

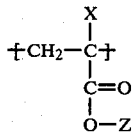

where X is H or $CH_3$ and Z is $C_nH_{2n+1}$, where $8 \leqq n \leqq 20$.

19. The method of claim 18 wherein said latex and said gel both consist essentially of an intimate admixture of a first vinyl polymer containing monomer units selected from the group consisting of:

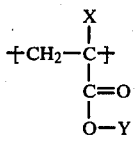

where X is H or $CH_3$ and Y is $C_nH_{2n+1}$, where $1 \leqq n \leqq 6$, and a second vinyl polymer containing monomer units selected from the group consisting of:

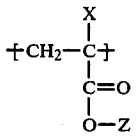

where X is H or $CH_3$ and Z is $C_nH_{2n+1}$, where $8 \leqq n \leqq 20$, said latex containing a major amount of said first polymer so that it remains insoluble in said carrier, said gel containing a major amount of said second polymer so that it swells in the presence of said carrier.

20. The method of claim 19 wherein said latex comprises about 3 parts by weight of said first polymer and about 1 part by weight of said second polymer.

21. The method of claim 19 wherein said gel comprises about 85 parts by weight of said second polymer and about 15 parts by weight of said first polymer.

22. The method of claim 19 wherein said first polymer is a copolymer of methacrylic acid and methyl methacrylate and said second polymer is a copolymer of lauryl methacrylate and glycidyl methacrylate.

23. The method of claim 17 wherein said charge control agent comprises a copolymer of butyl vinyl ether and vinyl chloride, comprising between about 5%–10% of the total weight of said composition, excluding the carrier.

24. The method of claim 17 wherein said charge control agent comprises a copolymer of about 25 parts by weight lower alkyl vinyl ether and about 75 parts by weight vinyl chloride.

25. The method of claim 17 wherein said charge control agent comprises a copolymer of lower alkyl vinyl ether and vinyl chloride containing covalently bonded anionic surfactant.

26. The method of claim 25 wherein said anionic surfactant comprises an alkali metal sulfonate substituted aliphatic surfactant containing between 10 and 40 carbon atoms.

27. The method of claim 18 wherein said developer further comprises wax and a wood rosin.

* * * * *